US006311631B1

(12) United States Patent
Beecher

(10) Patent No.: US 6,311,631 B1
(45) Date of Patent: Nov. 6, 2001

(54) JET-PROPELLED WATER BOARD

(76) Inventor: Ronald L. Beecher, Rte. #1 Box #2450, Saxe, VA (US) 23967

( * ) Notice: Subject to any disclaimer, the term of this patent is extended or adjusted under 35 U.S.C. 154(b) by 0 days.

(21) Appl. No.: 09/718,623

(22) Filed: Nov. 22, 2000

(51) Int. Cl.[7] ..... B63B 35/73
(52) U.S. Cl. ..... 114/55.56; 440/38; 441/74
(58) Field of Search ..... 114/151, 315, 114/556.56; 441/65, 74; 440/38

(56) References Cited

U.S. PATENT DOCUMENTS

| | | | | |
|---|---|---|---|---|
| D. 289,031 | | 3/1987 | Monostory . | |
| 3,941,076 | * | 3/1976 | Rice | 114/151 |
| 4,311,108 | | 1/1982 | Horton . | |
| 4,864,959 | | 9/1989 | Takamizawa et al. . | |
| 4,993,977 | | 2/1991 | Rodler, Jr. . | |
| 5,376,027 | | 12/1994 | Hergenrather . | |
| 5,401,195 | | 3/1995 | Yocom . | |

FOREIGN PATENT DOCUMENTS

| | | | | |
|---|---|---|---|---|
| 2053805 | * | 2/1981 | (GB) | 441/74 |
| 171583 | * | 6/1994 | (JP) | 441/74 |

* cited by examiner

*Primary Examiner*—Jesus D. Sotelo

(57) ABSTRACT

A jet-propelled water board for transporting a person upon water. The jet-propelled water board includes a board member having a top side and a bottom side, and also having a tapered front portion and a tapered back portion, and further having a plurality of water intake ports and water outtake ports being disposed through the bottom side of said board member; and also includes a fin being securely attached to the bottom side of the board member and on the back portion thereof; and further includes a jet propel assembly being disposed in the board member for forcing water through said the outtake ports.

13 Claims, 2 Drawing Sheets

JET-PROPELLED WATER BOARD

BACKGROUND OF THE INVENTION

1. Field of the Invention

The present invention relates to a power water board and more particularly pertains to a new jet-propelled water board for transporting a person upon water.

2. Description of the Prior Art

The use of a power water board is known in the prior art. More specifically, a power water board heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,311,108; U.S. Pat. No. 5,401,195; U.S. Pat. No. 4,993,977; U.S. Pat. No. 5,376,027; U.S. Pat. No. Des. 289,031; and U.S. Pat. No. 4,864,959.

While these devices fulfill their respective, particular objectives and requirements, the aforementioned patents do not disclose a new jet-propelled water board. The inventive device includes a board member having a top side and a bottom side, and also having a tapered front portion and a tapered back portion, and further having a plurality of water intake ports and water outtake ports being disposed through the bottom side of said board member; and also includes a fin being securely attached to the bottom side of the board member and on the back portion thereof; and further includes a jet propel assembly being disposed in the board member for forcing water through said the outtake ports.

In these respects, the jet-propelled water board according to the present invention substantially departs from the conventional concepts and designs of the prior art, and in so doing provides an apparatus primarily developed for the purpose of transporting a person upon water.

SUMMARY OF THE INVENTION

In view of the foregoing disadvantages inherent in the known types of power water board now present in the prior art, the present invention provides a new jet-propelled water board construction wherein the same can be utilized for transporting a person upon water.

The general purpose of the present invention, which will be described subsequently in greater detail, is to provide a new jet-propelled water board which has many of the advantages of the power water board mentioned heretofore and many novel features that result in a new jet-propelled water board which is not anticipated, rendered obvious, suggested, or even implied by any of the prior art power water board, either alone or in any combination thereof.

To attain this, the present invention generally comprises a board member having a top side and a bottom side, and also having a tapered front portion and a tapered back portion, and further having a plurality of water intake ports and water outtake ports being disposed through the bottom side of said board member; and also includes a fin being securely attached to the bottom side of the board member and on the back portion thereof; and further includes a jet propel assembly being disposed in the board member for forcing water through said the outtake ports.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new jet-propelled water board which has many of the advantages of the power water board mentioned heretofore and many novel features that result in a new jet-propelled water board which is not anticipated, rendered obvious, suggested, or even implied by any of the prior art power water board, either alone or in any combination thereof.

It is another object of the present invention to provide a new jet-propelled water board which may be easily and efficiently manufactured and marketed.

It is a further object of the present invention to provide a new jet-propelled water board which is of a durable and reliable construction.

An even further object of the present invention is to provide a new jet-propelled water board which is susceptible of a low cost of manufacture with regard to both materials and labor, and which accordingly is then susceptible of low prices of sale to the consuming public, thereby making such jet-propelled water board economically available to the buying public.

Still yet another object of the present invention is to provide a new jet-propelled water board which provides in the apparatuses and methods of the prior art some of the advantages thereof, while simultaneously overcoming some of the disadvantages normally associated therewith.

Still another object of the present invention is to provide a new jet-propelled water board for transporting a person upon water.

Yet another object of the present invention is to provide a new jet-propelled water board which includes a board member having a top side and a bottom side, and also having a tapered front portion and a tapered back portion, and further having a plurality of water intake ports and water outtake ports being disposed through the bottom side of said board member; and also includes a fin being securely attached to the bottom side of the board member and on the back portion thereof; and further includes a jet propel assembly being disposed in the board member for forcing water through said the outtake ports.

Still yet another object of the present invention is to provide a new jet-propelled water board that allows quicker response time for emergency situations upon water.

Even still another object of the present invention is to provide a new jet-propelled water board that can be easily and conveniently used as a recreational transportation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
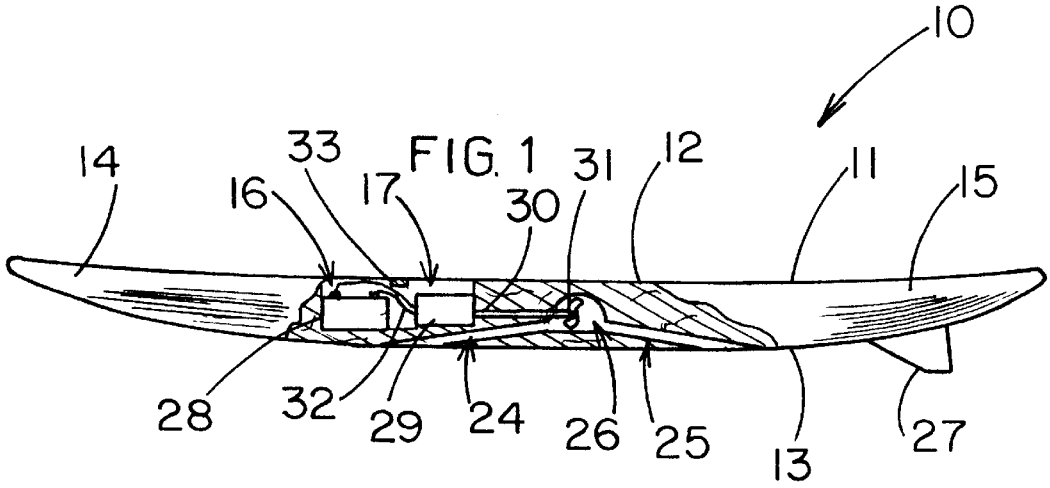
FIG. 1 is a cutaway side elevational view of a new jet-propelled water board according to the present invention.
Figure 2:
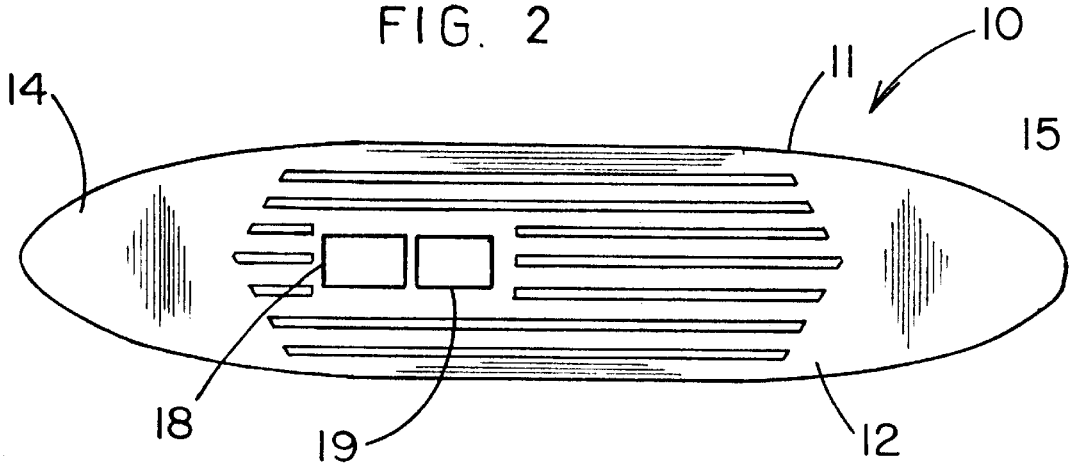
FIG. 2 is a top plan view of the present invention.
Figure 3:
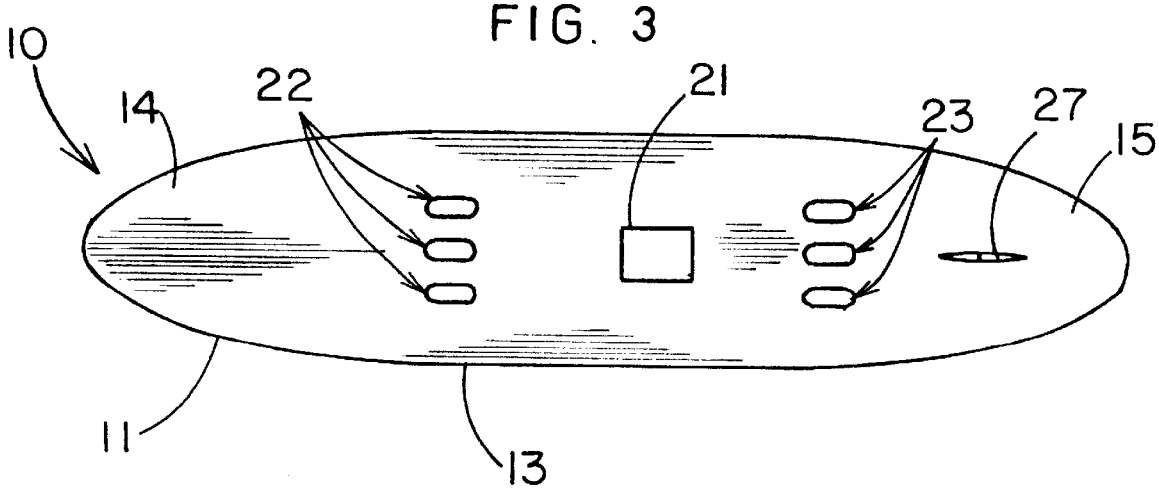
FIG. 3 is a bottom plan view of the present invention.
Figure 4:
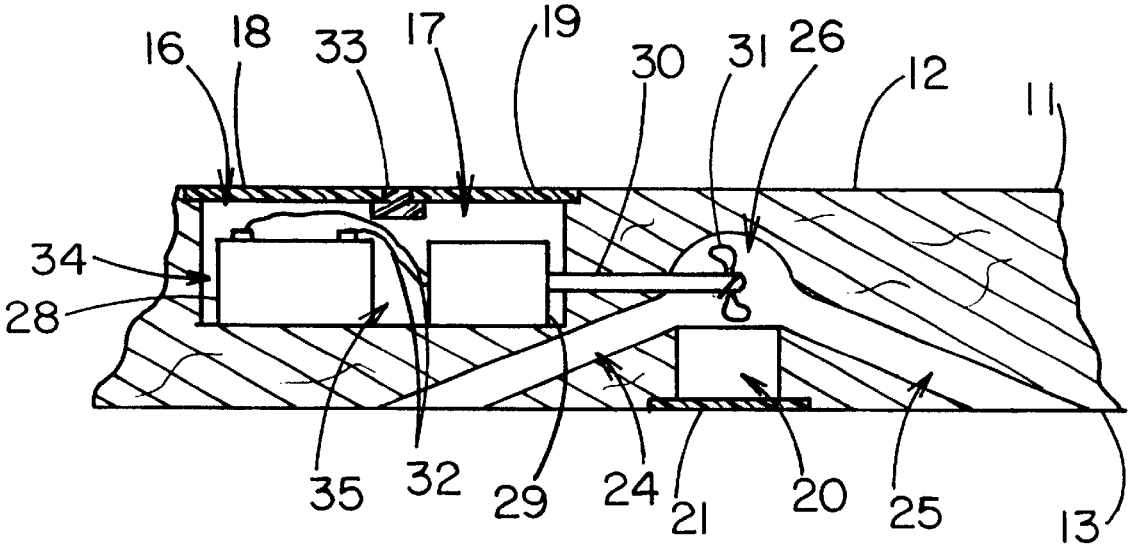
FIG. 4 is a detailed side cross-sectional view of the present invention.

With reference now to the drawings, and in particular to FIGS. 1 through 4 thereof, a new jet-propelled water board embodying the principles and concepts of the present invention and generally designated by the reference numeral 10 will be described.

As best illustrated in FIGS. 1 through 4, the jet-propelled water board 10 generally comprises a board member 11 having a top side 12 and a bottom side 13, and also having a tapered front portion 14 and a tapered back portion 15, and further having a plurality of water intake ports 22 and water outtake ports 23 being disposed through the bottom side 13 of the board member 11. The board member 11 further includes a plurality of channels 24,25 being conventionally disposed therein and being connected to the water intake and outtake ports 22,23. The channels 24,25 include water intake channels 24 being conventionally connected to the water intake ports 22, and also include water outtake channels 25 being conventionally connected to the water outtake ports 23. The board member 11 also includes a chamber 26 being disposed therein and interconnecting the water intake channels 24 with the water outtake channels 25. The board member 11 also includes compartment openings 16,17 being disposed through the top side 12 thereof, and further includes compartments 34,35 being disposed in the board member 11 and being closed and sealed with covers 18,19. The water intake ports 22 are disposed near the front portion 14 of the board member 11, and the water outtake ports 23 are disposed near the back portion 15 of the board member 11. The board member 11 also includes an access opening 20 disposed through the bottom side 13 thereof with the access opening 20 being closed and sealed with a cover member 21. The board member 11 has a length of approximately 9 feet, a thickness of approximately 8 inches, and a width of approximately 12 inches. A fin 27 is securely and conventionally attached to the bottom side 13 of the board member 11 and on the back portion 15 thereof.

A jet propel assembly is conventionally disposed in the board member 11 for thrusting water through the water outtake ports 23. The jet propel assembly includes a battery 28 being conventionally disposed in one of the compartments 34, and also includes a motor 29 being conventionally disposed in another of the compartments 35 and being connected to the battery 28 with wires 32, and further includes a shaft 30 being conventionally attached to the motor 29 and being rotatably extended in the chamber 26, and also includes a propeller 31 being securely and conventionally attached to the shaft 30 and being disposed in the chamber 26 for thrusting water from the water intake ports 22 and the water intake channels 24 through the water outtake channels and ports 23,25, and further includes a power switch 33 being conventionally connected to the battery 28 and to the motor 29 for energizing the motor 29 with the propeller 31 being accessible through the access opening 20 of the board member 11.

In use, the user places the board member 11 upon the water and either lies or sits upon the top side 12 of the board member 11 and turns on the power switch 33 to energize the motor 29 which rotates the propeller 31 to thrust water through the water outtake ports 23 for moving the board member 11 upon the water.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A jet-propelled water board comprising:

a board member having a top side and a bottom side, and also having a tapered front portion, a tapered back portion, and a central portion therebetween, said board member having a chamber formed therein and having a plurality of water intake ports and water outtake ports being disposed through said bottom side of said board member, a chamber being formed in said board member;

a fin being securely attached to said bottom side of said board member and on said back portion thereof; and a jet propel assembly being disposed in said board member for drawing water in through said water intake ports and forcing water through said water outtake ports, said jet propel assembly including a propeller rotatably mounted in said chamber;

a water intake channel extending from each of said water intake ports to said chamber for sucking water from an exterior of said board member to said chamber and a water outtake channel extending between said chamber and each of said water outtake ports for expelling water from said chamber to the exterior of said board member, said water intake channels extending generally in a forward direction from said chamber and said water outtake channels extending generally in a backward direction from said chamber, said water intake ports being located forward of a middle of said board member and said water outtake ports being located backward of the middle of said board member.

2. A jet-propelled water board as described in claim 1, wherein said board member also includes compartment openings disposed through said top side thereof, and further includes compartments being disposed in said board member and being closed and sealed with covers.

3. A jet-propelled water board as described in claim 2, wherein said water intake ports are disposed near said front portion of said board member, and said water outtake ports are disposed near said back portion of said board member.

4. A jet-propelled water board as described in claim 2, wherein said jet propel assembly includes a battery being disposed in one of said compartments, and also includes a motor being disposed in another of said compartments and being connected to said battery with wires, and further includes a shaft being attached to said motor and being rotatably extended in said chamber, said propeller being securely attached to said shaft for thrusting water from said water intake ports and said water intake channels through said water outtake channels and said water outtake ports, and further includes a power switch being connected to said battery and to said motor for energizing said motor.

5. A jet-propelled water board as described in claim 1, wherein said board member also includes an access opening disposed through said bottom side thereof with said access opening being closed and sealed with a cover member.

6. A jet-propelled water board as described in claim 1, wherein the bottom side of said board member has an access opening formed therein and said propeller is accessible through said access opening of said board member.

7. A jet-propelled water board as described in claim 1, wherein each of said channels is substantially linear between said chamber and said ports.

8. A jet-propelled water board as described in claim 1, wherein said central portion has a substantially uniform thickness between said front and back portions, and said ports being formed in said central portion.

9. A jet-propelled water board as described in claim 1, wherein said board member has a length defined between a front tip and a back tip of the board, said water intake ports being located approximately one-third of the length from the front tip to the back tip, and said water outtake ports being located approximately two-thirds of the length from the front tip to the back tip.

10. A jet-propelled water board comprising:

a board member having a top side and a bottom side, and also having a tapered front portion, a tapered back portion, and a central portion therebetween, said board member having a chamber formed therein and having a plurality of water intake ports and water outtake ports being disposed through said bottom side of said board member, said board member also including a chamber being formed in said board member, a water intake channel extending from each of said water intake ports to said chamber for sucking water from an exterior of said board member to said chamber and a water outtake channel extending between said chamber and each of said water outtake ports for expelling water from said chamber to the exterior of said board member, said water intake channels extending generally in a forward direction from said chamber and said water outtake channels extending generally in a backward direction from said chamber, said water intake ports being located forward of a middle of said board member and said water outtake ports being located backward of the middle of said board member, wherein each of said channels is substantially linear between said chamber and said ports, said board member also including compartment openings disposed through said top side thereof, and further including compartments being disposed in said board member and being closed and sealed with covers, said water intake ports being disposed near said front portion of said board member, said board member also including an access opening disposed through said bottom side thereof with said access opening being closed and sealed with a cover member;

a fin being securely attached to said bottom side of said board member and on said back portion thereof; and a jet propel assembly being disposed in said board member for drawing water in through said water intake ports and forcing water through said water outtake ports, said jet propel assembly including a battery being disposed in one of said compartments, and also including a motor being disposed in another of said compartments and being connected to said battery with wires, and further including a shaft being attached to said motor and being rotatably extended in said chamber, and also including a propeller being securely attached to said shaft and being disposed in said chamber for thrusting water from said water intake ports and said water intake channels through said water outtake channels and ports, and further including a power switch being connected to said battery and to said motor for energizing said motor, said propeller being accessible through said access opening of said board member.

11. A jet-propelled water board as described in claim 10, wherein said board member has a length of approximately 9 feet, a thickness of approximately 8 inches, and a width of approximately 12 inches.

12. A jet-propelled water board as described in claim 10, wherein said central portion has a substantially uniform thickness between said front and back portions, and said ports being formed in said central portion.

13. A jet-propelled water board as described in claim 12, wherein said board member has a length defined between a front tip and a back tip of the board, said water intake ports being located approximately one-third of the length from the front tip to the back tip, and said water outtake ports being located approximately two-thirds of the length from the front tip to the back tip.

* * * * *